US008567893B2

(12) United States Patent
Yeh et al.

(10) Patent No.: US 8,567,893 B2
(45) Date of Patent: Oct. 29, 2013

(54) PRINT SIGNAL GENERATION SYSTEM

(75) Inventors: Po-Chun Yeh, Tainan County (TW); Chia-Ming Chang, Taipei County (TW); Hung-Pin Shih, Miaoli County (TW); Tsu-Min Liu, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 373 days.

(21) Appl. No.: 12/691,627

(22) Filed: Jan. 21, 2010

(65) Prior Publication Data

US 2010/0225686 A1 Sep. 9, 2010

(30) Foreign Application Priority Data

Mar. 3, 2009 (TW) ..... 98106799 A

(51) Int. Cl.
*B41J 29/38* (2006.01)

(52) U.S. Cl.
USPC ..... 347/16; 347/5; 347/10; 347/14

(58) Field of Classification Search
USPC ..... 347/10
See application file for complete search history.

(56) References Cited

U.S. PATENT DOCUMENTS

| | | | | |
|---|---|---|---|---|
| 4,510,503 | A | 4/1985 | Paranjpe et al. | |
| 4,524,364 | A | 6/1985 | Bain et al. | |
| 6,068,362 | A * | 5/2000 | Dunand et al. | 347/16 |
| 6,302,506 | B1 | 10/2001 | Norton | |
| 6,557,961 | B2 | 5/2003 | Cheng et al. | |
| 6,650,864 | B2 * | 11/2003 | Miyamoto et al. | 399/384 |
| 6,733,101 | B2 * | 5/2004 | Katayama et al. | 347/14 |
| 7,918,521 | B2 * | 4/2011 | Furuya et al. | 347/10 |

FOREIGN PATENT DOCUMENTS

JP 2008110572 5/2008

OTHER PUBLICATIONS

Taiwan Patent Office, Office Action, Application Patent Serial No. 098106799, Sep. 13, 2012, Taiwan.

* cited by examiner

*Primary Examiner* — Laura Martin
*Assistant Examiner* — Jeremy Bishop

(57) ABSTRACT

An embodiment of a print signal generation system is provided. The system comprises a sensor, a divisor processing unit, a reference signal generator, and a print trigger signal generator. The sensor detects a first offset of a first location of a medium being printed. The divisor processing unit generates a first divisor according to the first offset and a predetermined divisor. The reference signal generator generates a reference signal. The print trigger signal generator generates a print trigger signal according to the first divisor and the reference signal.

19 Claims, 4 Drawing Sheets

PRINT SIGNAL GENERATION SYSTEM

CROSS REFERENCE TO RELATED APPLICATIONS

This Application claims priority of Taiwan Patent Application No. 098106799, filed on Mar. 3, 2009, the entirety of which is incorporated by reference herein.

BACKGROUND

1. Technical Field

The disclosure relates to a dynamic pulse modification method, and more particularly to a dynamic pulse modification method which can be applied in a print system which can compensate for deformation of a medium being printed or different distance printing.

2. Description of the Related Art

Typically, when an ink printer prints at a constant speed, the distances between each continuous two locations being printed are equal. If the printer must print at different distances, printing frequency is adjusted. However, adjusting printing frequency increases printer loading.

SUMMARY

An embodiment of a print signal generation system is provided. The system comprises a sensor, a divisor processing unit, a reference signal generator, and a print trigger signal generator. The sensor detects a first offset of a first location of a medium being printed. The divisor processing unit generates a first divisor according to the first offset and a predetermined divisor. The reference signal generator generates a reference signal. The print trigger signal generator generates a print trigger signal according to the first divisor and the reference signal.

An embodiment of a print signal generation method to control a printhead module to the print on a medium being printed is provided. The method comprises detecting a first offset of a first location; detecting a second offset of a second location; generating a first divisor according to the first offset, the second offset and a predetermined divisor; generating a print trigger signal according to the first divisor and a reference signal.

A detailed description is given in the following embodiments with reference to the accompanying drawings.

BRIEF DESCRIPTION OF THE DRAWINGS

The disclosure can be more fully understood by reading the subsequent detailed description and examples with references made to the accompanying drawings, wherein.

DETAILED DESCRIPTION

The following description is of the best-contemplated mode of carrying out the disclosure. This description is made for the purpose of illustrating the general principles of the disclosure and should not be taken in a limiting sense. The scope of the disclosure is best determined by reference to the appended claims.

Figure 1:
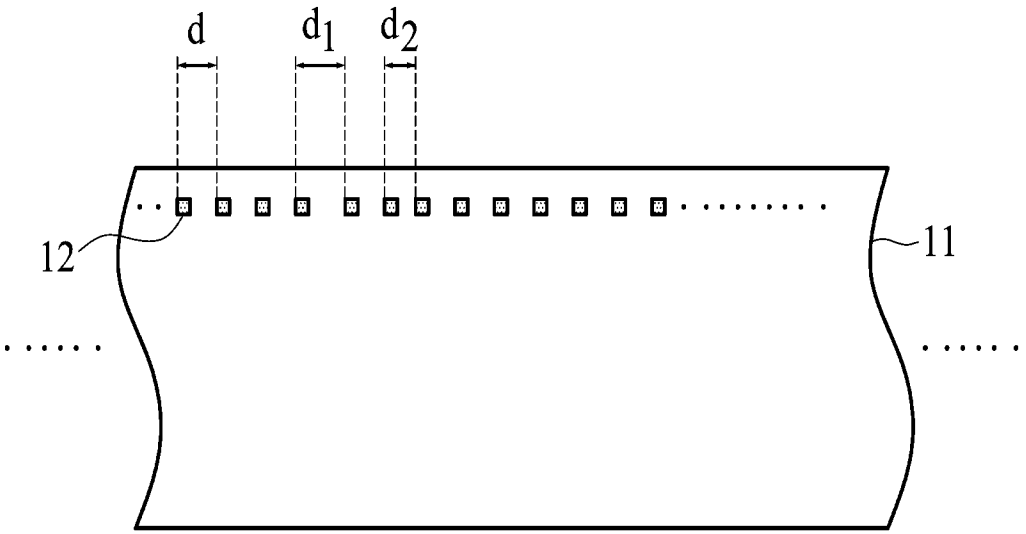
FIG. 1 is a schematic diagram of a medium being printed with alignment marks.

FIG. 1 is a schematic diagram of a medium being printed with alignment marks. The medium being printed 11 comprises a plurality of alignment marks 12. In ideal conditions, the distances between each two successive alignment marks are the same. However, the medium being printed 11 may be deformed during printing, and the distances between the two alignment marks may increase or decrease, such as shown as d1 and d2. Thus, the printer calibrates to avoid the print error. In this embodiment, the medium being printed 11 may be made by a flexible laminate material, plastic material or a flexible high polymer material.

Figure 2:
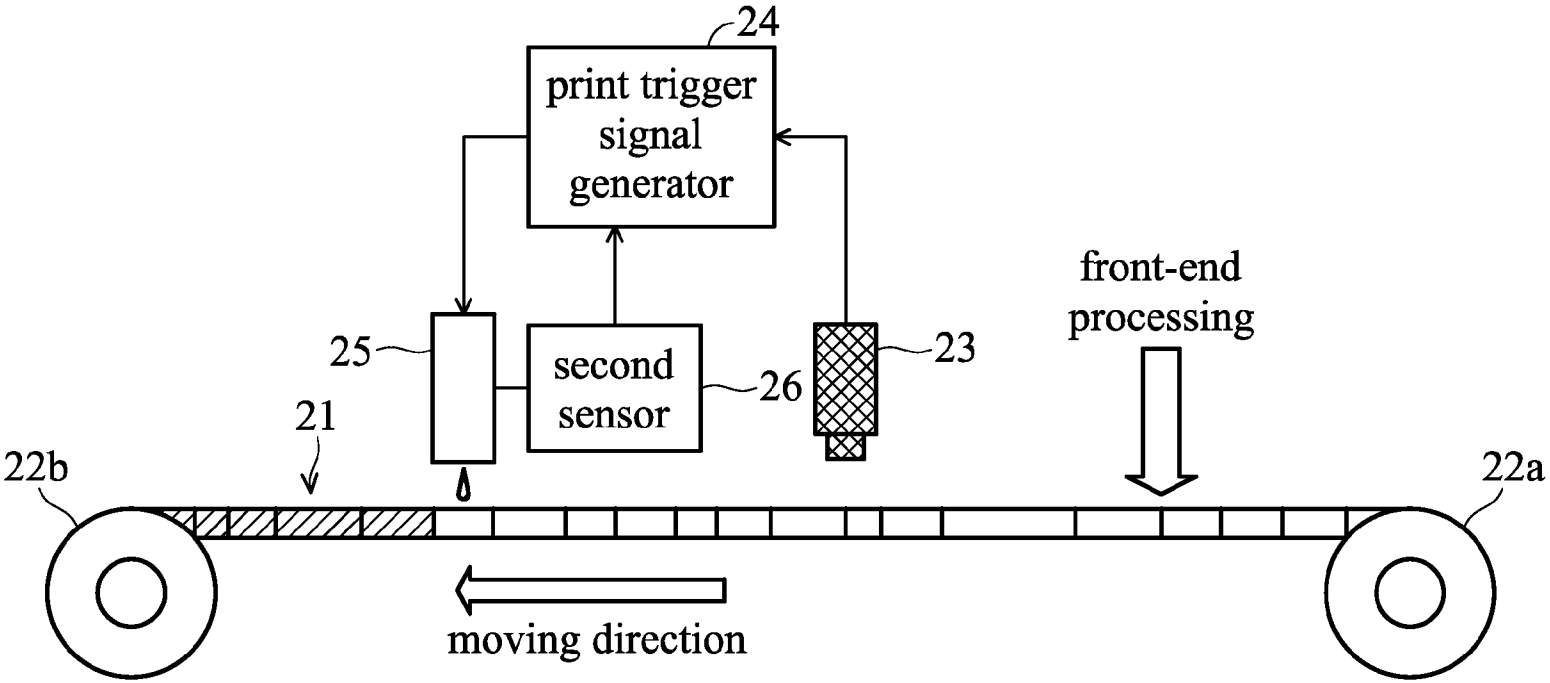
FIG. 2 is a schematic diagram of an embodiment of a print system according to the disclosure.

FIG. 2 is a schematic diagram of an embodiment of a print system according to the disclosure. The flexible substrate 21 may be deformed due to front-end processing, such as heating, or a pulling force caused by two rollers 22*a* and 22*b*. Thus, the sensor 23 is used to detect whether the flexible substrate 21 is deformed. Referring to FIG. 1, in one embodiment of the flexible substrate 21, the sensor 23 detects the distance between each two successive alignment points on the flexible substrate 21. When the sensor 23 detects that the distance between the two alignment points is not equal to a predetermined distance d, such as dl or d2, the sensor 23 transforms the difference between the distance between the two alignment points and the predetermined distance d into a calibration data, and transmits the data to the print trigger signal generator 24. The print trigger signal generator 24 generates a corresponding print trigger signal to drive the printhead module 25 to the print on the flexible substrate 21. In this embodiment, the sensor 23 may be a contact sensor or a contactless sensor, and the printhead module 25 comprises at least one printhead.

In another embodiment, the sensor 23 can directly transmit the difference between the distance between the two alignment points and the predetermined distance d to the print trigger signal generator 24, and the print trigger signal generator 24 can directly adjust the print trigger signal according to the difference.

In another embodiment, the print trigger signal generator 24 comprises a counter for counting the cycles of the reference signal. The print trigger signal generator 24 receives a reference signal, the frequency of the reference signal is higher than the print frequency of the printhead module 25, and the frequency of the reference signal corresponds to the moving speed of the medium being printed. Take FIG. 1 for example, assuming the moving time for the flexible substrate 21 moving the distance d between the two alignment points corresponds to M cycles of the reference signal, T, the counter outputs a print trigger signal to the printhead module 25 every M cycles of the reference signal.

If the distance becomes $d_1$ between the two alignment points and the counter still outputs a print trigger signal to the printhead module 25 at each M reference signal cycles, the actual print point is advanced to the desirable print point. Thus, when the sensor 23 detects that a difference between the actual distance between the two alignment points and a predetermined distance d exists, a value X of cycles required by the flexible substrate for moving the difference is calculated and transmitted to the print trigger signal generator 24. Thus, the print trigger signal generator 24 outputs a print trigger signal to the printhead module 25 at the (M+X)th reference signal cycle. Therefore, the actual print position by the printhead module 25 will be at the predetermined location.

In this embodiment, the value of X may be positive or negative according to the difference. In this embodiment, M and X are positive integers, but the disclosure is not limited thereto.

Figure 3:
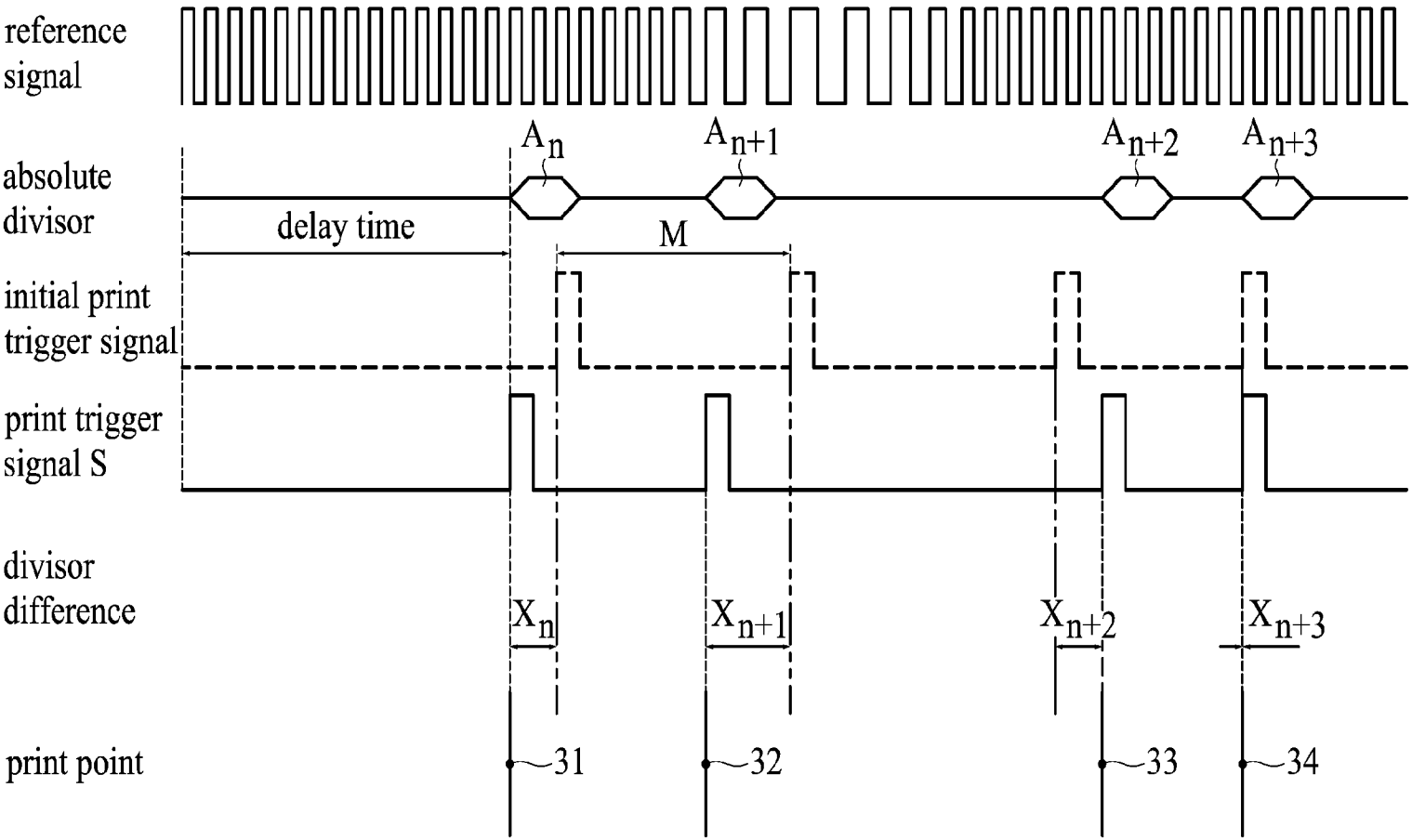
FIG. 3 is a schematic diagram of an embodiment of a print trigger signal according to the disclosure.

FIG. 3 is a schematic diagram of an embodiment of a print trigger signal according to the disclosure. The reference signal is generated by a linear scale. The linear scale generates the reference signal according to the relative movement of the medium being printed and the printhead. In other words, if the print speed slows down, the frequency of the reference signal accordingly decreases. The initial divisor M indicates that the counter outputs a print trigger signal to the printhead every M cycles of the reference signal when the medium being printed is not deformed. In this case, since the medium being printed is deformed, the actual print trigger signal received by the printhead is shown as the print trigger signal S.

The divisor difference is generated by a sensor. The sensor detects whether the medium being printed is deformed. If the deformation is detected, the sensor generates the divisor difference according to the deformation amount. Please refer to FIG. 2. Since the sensor 23 is disposed in front of the printhead module 25, the divisor difference is transmitted to the print trigger signal generator 24 for generating a corresponding print trigger signal before the printhead module 25 prints.

The absolute divisor A is for the print trigger signal S of the print trigger signal generator 24. The print trigger signal generator 24 comprises a counters for counting the cycles of the reference according to the absolute divisor $A_n$ and generates a corresponding print trigger signal S. For example, the initial value of M is 8, and the divisor differences $X_n$, $X_{n+1}$, $X_{n+2}$ and $X_{n+3}$ respectively are −2, −2, 2 and 0. In this embodiment, the negative sign indicates that the actual print point leads the predetermined print point.

In this embodiment, a divisor unit generates the absolute divisor $A_n$ according to $X_n$ and $X_{n+1}$. The divisor unit may be in the print trigger signal generator 24. In this embodiment, the absolute divisor $A_n$ is determined by the following equation: $A_n=M-X_n+X_{n+1}$. By substituting the values to the equation, we can acquire that $A_n$ is 8. In other words, after the first print point 31 is printed, the counter of the print trigger signal generator 24 counts the reference signal and the print trigger signal S is asserted to a high voltage level when counting to the eighth cycle, and the printhead module accordingly prints the second print point 32.

When printing the second print point 32, the divisor unit generates the absolute divisor $A_{n+1}$. The absolute divisor $A_{n+1}$ is determined by the following equation: $A_{n+1}=M-X_{n+1}+X_{n+2}$. By substituting the values to the equation, we can acquire that $A_{n+1}$ is 12. In other words, after the second print point 32 is printed, the counter of the print trigger signal generator 24 counts the reference signal and the print trigger signal S is asserted to a high voltage level when counting to the twelfth cycle, and the printhead module accordingly prints the third print point 33.

Similarly, when the second print point 33 is printed, the divisor unit generates the absolute divisor $A_{n+2}$. The absolute divisor $A_{n+2}$ is determined by the following equation: $A_{n+2}=M-X_{n+2}+X_{n+3}$. By substituting the values to the equation, we can acquire that $A_{n+2}$ is 6. In other words, after the third print point 33 is printed, the counter of the print trigger signal generator 24 counts the reference signal and the print trigger signal S is asserted to high voltage level when counting to the sixth cycle, and the printhead module accordingly prints the fourth print point 34.

According to the described mechanism, the print error due to the deformation of the medium being printed can be overcome, and the described mechanism can be used for the medium being printed with different distances between two successive locations or the print system with erratic print speed. The described print mechanism can generate a print trigger signal according to a high resolution reference signal without increasing print data and ink can accordingly be correctly jetted on the medium being printed.

In this embodiment, the delay time compensates for the error of the printhead module when assembling. The delay time is transformed into a delay time or an advance time of print. Then, the delay time or advance time is transmitted to the print trigger signal generator 24 to generate the print trigger signal to compensate for the error of the printhead module when assembling. The error of the printhead module when assembling can be detected by a second sensor 26 (shown in FIG. 2) or be pre-stored in the print system for the print trigger signal generator to generate a corresponding compensation time.

Figure 4:
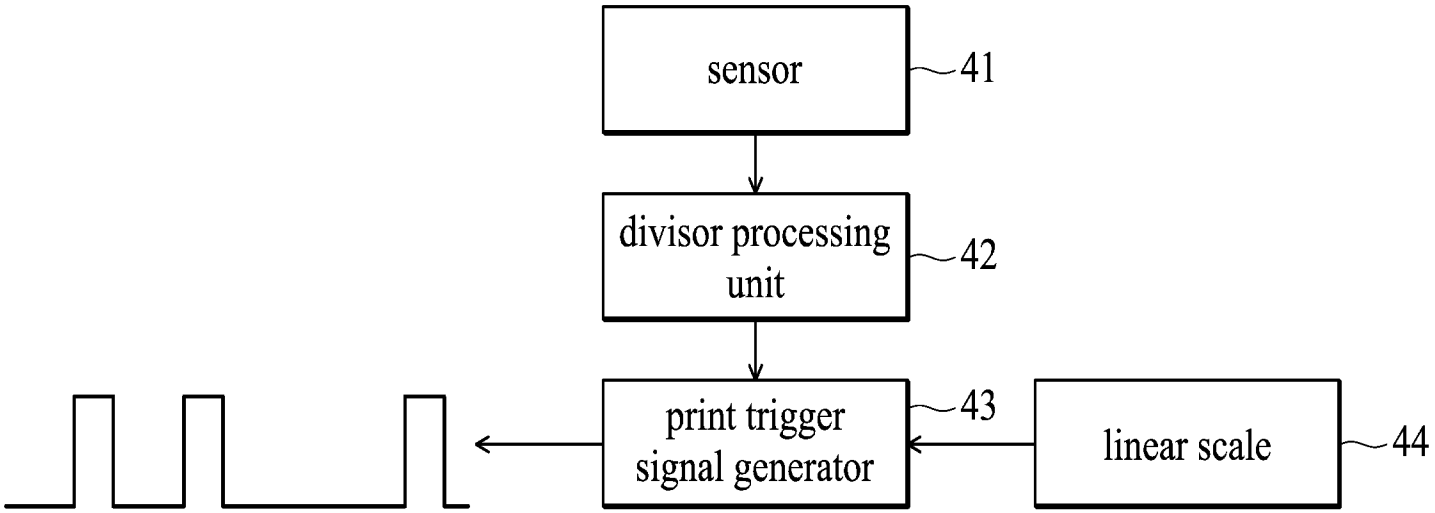
FIG. 4 is a schematic of an embodiment of a print system with a dynamic adjustable print trigger signal according to the disclosure.

FIG. 4 is a schematic of an embodiment of a print system with a dynamic adjustable print trigger signal according to the disclosure. The sensor 41 detects whether the positions on the medium being printed change. If the positions change, a compensation signal is generated according to the offset of the positions, and the sensor 41 converts the compensation signal into a divisor. The compensation signal may be the distance offset of the positions and the divisor may be an integer value according to the print speed of the print system. The divisor processing unit 42 generates and transmits a first divisor according to a predetermined divisor and at least one received divisor. The linear scale 44 generates a reference signal according to the relative movement of the medium being printed and the printhead. The print trigger signal generator 43 receives the first divisor and the reference signal to generate the print trigger signal.

In this embodiment, the sensor 41 may be a contact sensor or a contactless sensor. In another embodiment, the sensor 41 can be replaced by other devices and the divisor difference can be acquired by using software. Furthermore, the print system of this embodiment can be applied in a roll-to-roll printer or a flatbed printer.

While the disclosure has been described by way of example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A print signal generation system, comprising:

a sensor to detect a first offset of a first location of a medium being printed and a second offset of a second location of the medium being printed;

a divisor processing unit to generate a first divisor according to the first offset, the second offset and a predetermined divisor;

a reference signal generator to generate a reference signal; and a print trigger signal generator to count a number of cycles of the reference signal and generate a print trigger signal when the number of cycles equals the first divisor, wherein the first and the second offsets respectively correspond to a first and a second deformation amount of the medium being printed, and wherein the first and the second deformation amounts of the medium are respectively detected by the difference between an ideal distance between two successive alignment marks on the medium and an actual distance between the alignment marks.

2. The system as claimed in claim 1, wherein the sensor further detects a third offset of a third location of the medium being printed, and the divisor processing unit generates a second divisor according to the second offset, the third offset and the predetermined divisor.

3. The system as claimed in claim 2, wherein the distance between the first location and the second location is not equal to the distance between the second location and the third location.

4. The system as claimed in claim 1, wherein the sensor is a contact sensor or a contactless sensor.

5. The system as claimed in claim 1, wherein the reference signal generator generates the reference signal according to a relative movement of a printhead module and the medium being printed.

6. The system as claimed in claim 1, wherein the print trigger signal generator further converts the first offset into a first value and the first divisor is determined according to the predetermined divisor and the first value.

7. The system as claimed in claim 6, wherein the first value is one of a positive integer number, zero or a negative integer number.

8. The system as claimed in claim 1, wherein the frequency of the reference signal is higher than a print frequency of a printhead module of the print signal generation system.

9. The system as claimed in claim 1, wherein the print signal generation system can be applied in a roll-to-roll printer or a flatbed printer.

10. The system as claimed in claim 1, wherein a second sensor detects a time offset which is determined according to an offset of a printhead module of the print signal generation system.

11. The system as claimed in claim 1, further comprising a printhead module driven by the print trigger signal.

12. A print signal generation method to control a printhead module to the print on a medium being printed, comprising:

detecting a first offset of a first location;

detecting a second offset of a second location;

generating a first divisor according to the first offset, the second offset and a predetermined divisor; and counting a number of cycles of a reference signal and generating a print trigger signal to drive a printhead to print when the number of cycles equals the first divisor, wherein the first and second offsets respectively correspond to a first and second deformation amount of the medium being printed, and wherein the first and the second deformation amounts of the medium are respectively detected by the difference between an ideal distance between two successive alignment marks on the medium and an actual distance between the alignment marks.

13. The method as claimed in claim 12, further comprising:

detecting a third offset of a third position;

generating a second divisor according to the third offset, the second offset and the predetermined divisor;

generating the print trigger signal according to the first divisor, the second divisor and the reference signal.

14. The method as claimed in claim 13, wherein a first distance between the first location and the second location is not equal to a second difference between the second location and a third location.

15. The method as claimed in claim 12, further comprising:

detecting an offset of the printhead module; and generating a print trigger signal according to the offset, the first divisor and the reference signal.

16. The method as claimed in claim 12, wherein the reference signal is generated according to a relative movement of a printhead module and the medium being printed.

17. The method as claimed in claim 12, wherein the frequency of the reference signal is a time-variable.

18. The system as claimed in claim 1, wherein the print trigger signal drives a printhead to print on a medium.

19. A print signal generation method to control a printhead module to the print on a medium being printed, comprising:

measuring a distance between two alignment marks on the medium being printed;

estimating a distance error between the distance and a predetermined distance corresponding to a deformation amount of the medium being printed;

generating a print trigger signal by adjusting a trigger time of an initial print trigger signal according to the distance error; and printing on the medium according to the trigger signal.

* * * * *